United States Patent [19]

Kunugi et al.

[11] Patent Number: 5,053,821

[45] Date of Patent: Oct. 1, 1991

[54] ELECTROPHOTOGRAPHIC IMAGE FORMING APPARATUS USING PHOTOCONDUCTIVE TONER

[75] Inventors: Masanao Kunugi; Hajime Kurihara; Teruyuki Mizumoto, all of Suwa, Japan

[73] Assignee: Seiko Epson Corporation, A Corporation of Japan, Tokyo, Japan

[21] Appl. No.: 479,001

[22] Filed: Feb. 12, 1990

Related U.S. Application Data

[62] Division of Ser. No. 253,514, Oct. 5, 1988.

[30] Foreign Application Priority Data

| | | | |
|---|---|---|---|
| Oct. 6, 1987 | [JP] | Japan | 62-252034 |
| Feb. 22, 1988 | [JP] | Japan | 63-38818 |
| Apr. 18, 1988 | [JP] | Japan | 63-95116 |

[51] Int. Cl.[5] ..... G03G 15/06

[52] U.S. Cl. ..... 355/245; 355/251; 355/326

[58] Field of Search ..... 430/31, 45, 46, 126, 430/901; 355/210, 245, 251, 326, 327, 211

[56] References Cited

U.S. PATENT DOCUMENTS

| | | | |
|---|---|---|---|
| 2,758,939 | 8/1956 | Sugarman . | |
| 3,676,118 | 2/1972 | Mott et al. | 430/31 X |
| 3,852,208 | 12/1974 | Nagashima | 430/901 X |
| 4,007,044 | 2/1977 | Shiga | 430/46 X |
| 4,521,502 | 6/1985 | Sakai et al. | 355/327 X |
| 4,542,084 | 9/1985 | Watanabe et al. | 430/42 X |
| 4,693,951 | 9/1987 | Takasu et al. | 430/31 |
| 4,921,768 | 5/1990 | Kunugi et al. | 430/45 |
| 4,950,570 | 8/1990 | Sano et al. | 430/31 X |

FOREIGN PATENT DOCUMENTS

| | | | |
|---|---|---|---|
| 855153 | 11/1970 | Canada | 430/46 |
| 58-114043 | 7/1983 | Japan . | |
| 58-153957 | 9/1983 | Japan . | |
| 59-078358 | 5/1984 | Japan . | |
| 61-017155 | 1/1985 | Japan . | |
| 60-031150 | 2/1985 | Japan . | |
| 60-138566 | 7/1985 | Japan . | |
| 60-205469 | 10/1985 | Japan . | |
| 60-205471 | 10/1985 | Japan . | |
| 61-009657 | 1/1986 | Japan . | |
| 61-017156 | 1/1986 | Japan . | |
| 61-018970 | 1/1986 | Japan . | |
| 61-018971 | 1/1986 | Japan . | |
| 61-018972 | 1/1986 | Japan . | |
| 61-018973 | 1/1986 | Japan . | |
| 61-018974 | 1/1986 | Japan . | |
| 61-034554 | 2/1986 | Japan . | |
| 61-230154 | 10/1986 | Japan . | |
| 61-230155 | 10/1986 | Japan . | |
| 61-230156 | 10/1986 | Japan . | |
| 61-230157 | 10/1986 | Japan . | |

*Primary Examiner*—Joan H. Pendegrass
*Assistant Examiner*—Robert Beatty
*Attorney, Agent, or Firm*—Blum Kaplan

[57] ABSTRACT

A photoconductive image forming apparatus in which charged photoconductive toner contacts a transparent insulating substrate and is exposed from within the substrate. Exposure reduces the resistivity of the toner so that its charge can be reversed by a bias voltage and the exposed toner will adhere to the image forming substrate simultaneously with exposure and then transfer to a transfer medium. In an alternative embodiment of the invention, a layer of toner is applied to an electroconductive substrate and the toner layer is exposed with a latent image. The charge of the exposed toner is reversed and the exposed toner is removed by an intermediate toner removal device. The remaining toner is then transferred to a transfer medium. Toner suitable for use includes azo-type metal containing black dyes which do not absorb the exposure and can be sensitized to the near infrared region. Multicolor toners, each sensitized to a different exposure wavelength are provided so that a single multiple wavelength exposure and a single development can be used to form multicolor images.

20 Claims, 4 Drawing Sheets

ELECTROPHOTOGRAPHIC IMAGE FORMING APPARATUS USING PHOTOCONDUCTIVE TONER

This is a division of application Ser. No. 07/253,514, filed Oct. 5, 1988.

BACKGROUND OF THE INVENTION

The invention relates generally to photoconductive image forming, and more particularly to photoconductive image forming utilizing photoconductive toner deposited on an image forming substrate.

There are several conventional photoconductive image forming methods, such as, Sugarman's method in U.S. Pat. No. 2,758,939 which is conventional, and does not use photoreceptors. Accordingly, it is easier to form color images with Sugarman's method than with electrophotographic methods of electrostatically forming images by use of photoreceptors and either insulating or electroconductive dry toners.

In Japanese unexamined application No. 60-138566 by Toshiba Electric Co. image formation is by forming a thin layer of photoconductive toner which is negatively charged with carriers on the entire surface of a transparent and electroconductive rotating hollow substrate by a magnetic brush. The toner layer is exposed to an image which is projected from the inside of the hollow substrate. The exposure reduces the resistance of the exposed toner so that static positive charges are applied to the exposed toner while a bias voltage is applied. The positively charged toner particles are transferred to a recording paper by electric field inducement.

This method has drawbacks since it is difficult to form a thin, controlled layer of photoconductive toner over the entire surface of the electroconductive substrate. Further, since the exposed toner is transferred to the transfer paper at the same time as the exposure, unexposed toner also contacts the transfer paper. This results in this unexposed toner being transferred to the transfer paper, resulting in images with undesirable background fog.

Additional transfer methods have been proposed in Japanese unexamined application Nos.: 60-205469, 60-205471, 61-17155, 61-17156 and 61-18970-18974, proposed by Konishiroku Co. According to this method, photoconductive toners and carriers are formed into a "magnetic brush". A direct image exposure is applied from above the magnetic brush and unexposed photoconductive toner is caused to fly to a counter electrode substrate and then transferred onto transfer paper.

This method also has shortcomings. The unexposed toner which flies to the conducting substrate causes unavoidable scattering. Therefore, it is difficult to obtain suitably clear images. Further, the method described in the aforementioned patents involve an excessive number of image forming steps. This increases the size, complexity and cost of an apparatus for practicing this method.

An image forming method utilizing simultaneous exposure and toner development which does not utilize photoconductive toners was proposed in Japanese unexamined application No. 58-153957. During exposure the surface of a photoreceptor is rubbed with a brush of electroconductive magnetic toner to which a bias voltage is applied. The amount of electrostatic charge applied to the electroconductive magnetic toner in contact with the surface of the photoreceptor varies greatly between the unexposed area of the photoreceptor which functions as an insulator and the exposed area which acts as a conductor. The toner image is formed by utilizing the differences in the charge between toner corresponding to exposed portions and nonexposed portions to transfer the image to a transfer medium.

This image forming method also has drawbacks. It is undesirable to incorporate photoreceptors into an image forming apparatus. Secondly, transferring toner to recording paper by this method does not transfer toner to the paper properly. During corona transfer, the toner charges are neutralized during the short relaxation time due to their electroconductive properties. This decreases their residual charge and thereby decreases their electrostatic attraction to the recording paper.

Conventional toners proposed for use in photoconductive image forming methods are not fully satisfactory. These toners generally have a basic composition and include inorganic material such as dye-sensitized ZnO, dye-sensitized $TiO_2$ or organic photoconductive agents, such as phthalocyanine, quinacridone and benzidine as well as binders and colorants. Examples of conventional dye-form photoconductive agents are described in Japanese unexamined application No. 61-230154-230157 by Ricoh Co. Toners in which the photosensitive wave length has been extended from the visible region to near infrared wave lengths (400 nm–750 nm) have been described in Japanese unexamined application Nos. 61-9657 and 61-34554 by Toshiba Electric Co. Further, Japanese unexamined application No. 59-78358 describes the photoreceptor sensitization of ZnO the typically utilized photoconductive agent, to the near infrared wave length region.

These conventional toners are not completely acceptable. The choice of photoconductive agent, colorant and sensitizer is dependent on the selected light source which complicates the production process and increases toner costs. The photosensitivity and electrical properties of the toners is reduced when they are blended. This is especially unsuitable when mixed photoconductive agent and black colorant is used. Furthermore, when carbon black is used as the black colorant, because the absorption region is extended from the visible region to the infrared region, the photosensitivity of photoconductive toners is significantly reduced.

Inexpensive semiconductor lasers expose in the near infrared region Because conventional photoconductive toners cannot be effectively sensitized to the near infrared wave length region, it is difficult to use inexpensive semiconductor lasers for the writing light source. This increases the cost of the apparatus.

Transfer of color images with a photoconductive toner method is described in Japanese unexamined application No. 58-114043. Three colored photoconductive toners are mixed. A layer of toners is formed on a roller and exposed and charged simultaneously through a transparent electrode and transferred to a recording sheet by a transfer roller. Additionally, Japanese unexamined application No. 60-31150 (Sony Corporation) proposes that three colored photoconductive toners are mixed and a layer of the mixed toners is formed on a conductive substrate. The substrate is exposed three separate times from above the photoconductive toner layer. Exposure creates differences in charge between exposed and nonexposed toners are separated to form color images. Because it is difficult to form a single layer of photoconductive toners with conventional image forming methods and colored toners, the conventional color methods are also not fully acceptable. Problems include poor color reproduction and poor image quality.

Accordingly, it is desirable to provide for photoconductive imaging forming which does not suffer from these shortcomings of the prior art.

SUMMARY OF THE INVENTION

Generally speaking, in accordance with the invention, photoconductive image forming is provided by selectively transferring toner corresponding to an image from a conductive support to a transparent image forming substrate and transferring the adhered toner to a transfer medium. The toner image is formed by exposing the toner to light from the opposite surface of the image forming substrate to lower the resistivity of exposed toner. A bias voltage is applied between the image forming substrate and the electroconductive support. Unexposed toner is not charged because its resistivity is too high and does not adhere to the substrate. The exposed toner image which adheres to the substrate is transferred to a transfer medium.

In an alternative embodiment, a thin layer of charged toner is applied to an electroconductive substrate. The layer of toner is exposed with a "negative" image which becomes oppositely charged and is removed to an intermediate transfer surface. The unexposed toner remaining on the substrate is transferred to a transfer medium in the form of the desired image.

The image forming apparatuses in accordance with the invention include a two component magnetic brush for charging toner and contacting it to a transparent image forming substrate or electroconductive substrate. An image writing exposure device is provided within the substrate to expose and thereby selectively reduce the resistivity of the exposed toner. Exposed toner can then be oppositely charged and will adhere to the substrate in the form of an image which is transferred to a recording medium by an intermediate transfer device.

Improved toners suitable for use in image forming in accordance with the invention are azo-type metal dyes which have no absorption over the visible wavelength and can be sensitized to different exposure wavelengths In this manner, different color toners, sensitized to different wavelengths can be used to form multicolor images The toners can also be sensitized to the near infrared region so that inexpensive near infrared lasers can be utilized as the writing device.

Accordingly, it is an object of the invention to provide an improved image forming method and apparatus capable of forming clear images having a high contrast ratio, good reproducibility and no background fog.

Another object of the invention is to provide improved photoconductive toners having sensitivity to near infrared wave length radiation and yielding clearer images with good reproducibility.

A further object of the invention is to provide improved photoconductive toners which maintain their charging properties and their sensitivity over long periods of time.

Still another object of the invention is to provide an improved photoconductive image forming apparatus which is simpler, smaller and costs less than conventional apparatuses.

Still a further object of the invention is to provide an improved photoconductive toner containing an azo-type metal containing black dye.

Yet another object of the invention is to provide an improved photoconductive toner containing a cyanine-type dye.

Other objects and advantages of the invention will in part be obvious and will be in part be apparent from the specifications and drawings.

The invention accordingly comprises the several steps and the relation of one or more of such steps with respect to each of the others, and the toner and the image forming apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
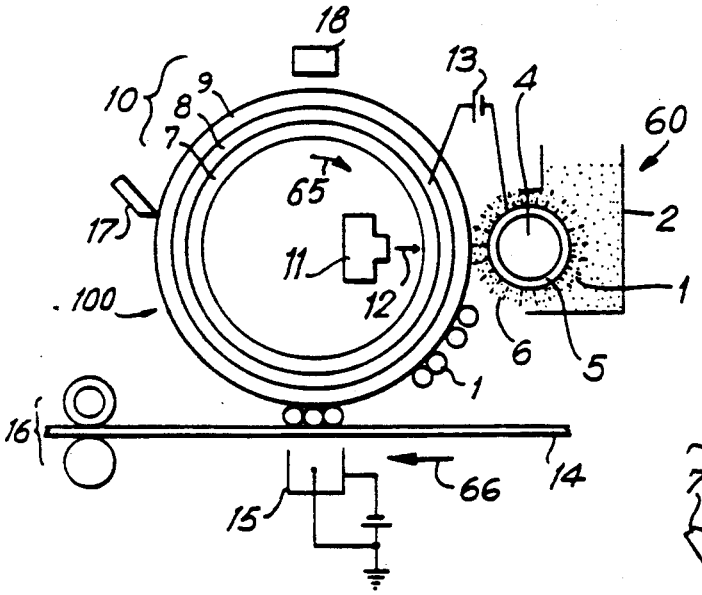
FIG. 1 is a schematic diagram of an apparatus for forming an image by the photoconductive method in accordance with the invention.

Images are formed by a photoconductive method in accordance with the invention as follows. Photoconductive toners are triboelectrically charged by a ridged brush-like layer of electroconductive carriers. The mixture of photoconductive toners and electroconductive carriers are formed into a two component magnetic brush. The combination of toner and carriers is referred to as a developer.

At the time charged toner particles contact the surface of a transparent insulative image forming substrate, the toner contacting the substrate is exposed to light corresponding to an image. Exposure decreases the resistance of the toner to current flow. A bias voltage is applied between the toner and the image forming substrate. The bias voltage is set high enough to reverse the charge of low resistance exposed toner, but low enough so that it cannot reverse the charge of unexposed toner. Because exposed toner can be charged with a polarity opposite to the polarity of the image forming substrate, the exposed toner selectively adheres to the image forming substrate in the form of a desired image. The toner is then transferred to an appropriate transfer medium to which it is fixed.

In an alternative embodiment of the invention, a thin layer of charged toner is applied to an electroconductive substrate. The layer of toner is subjected to an exposure corresponding to a "negative" image. The resistivity of exposed toner is reduced so that its charge can be reversed by a bias voltage. The bias voltage is set low enough so that it will not reverse the charge of unexposed toner. The exposed toner is then removed by an intermediate toner removal device charged with the same polarity as unexposed toner. Accordingly unexposed toner, in the form of a desired image is not removed and is then transferred from the substrate to a transfer medium.

Image formation in accordance with the invention can be modified by including a mixture of differently colored photoconductive toners, each of which are sensitized to different electromagnetic wave lengths. Accordingly, concurrent exposure of different wave lengths will selectively deposit different color toners to form multicolor images.

Improved toners in accordance with the invention further improve on the photoconductive image forming method. Black dyes including azo-type metals are superior to conventional toners It is a further improvement that the black dyes containing azo-type metals have no absorption wave length corresponding to the photosensitive wave length region of the photoconductive toners employed in accordance with the invention. Specifically, toners containing cyanine type dyes having a peak in the near infrared wavelength yield superior results.

An image forming apparatus constructed in accordance with the invention will perform the above described improved photoconductive image forming method. The apparatus includes a developer, a writing device and a substrate to transfer toner from the developing machine to a transfer medium after the toner is exposed by the writing device.

Figure 2:
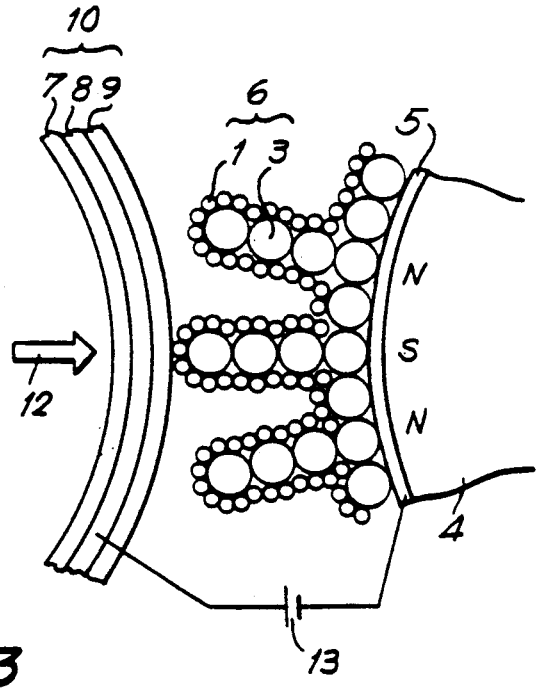
FIG. 2 is an enlarged sectional view of a portion of the apparatus of FIG. 1.

In FIGS. 1 and 2 a photoconductive image transferring apparatus 100 for forming images with a photoconductive toner 1 in accordance with the invention is shown. The resistivity of toner 1 is reduced during appropriate exposure. Throughout the application, similar structures illustrated in the FIGURES will be identically numbered.

Developer 60 contains a quantity of photoconductive toner 1 in a hopper 2. Toner 1 is eventually transferred to a transparent insulative image forming substrate 10 to form images on a transfer medium 14. To deposit toner 1 from hopper 2 to substrate 10, developing machine 60 utilizes a two component magnetic brush 6, formed on the surface of an electroconductive sleeve 5 disposed on a magnetic roller 4. Magnetic brush 6 is formed of a ribbed brush like layer of magnetic conductive carriers 3 and a layer of toner 1 disposed on the surface of carriers 3.

For simplicity, the following description will be in terms of charging toner 1 negatively. However, the invention is equally applicable to charging toner 1 positively and reversing the polarity of all other charges. Charging choice depends on the charging characteristic of the specific toner employed.

Toner 1 is triboelectrically negatively charged by carriers 3 and brought into contact with image forming substrate 10. Image forming substrate 10 is formed of a transparent support layer 7 having a transparent electroconductive layer 8 laminated thereon and a transparent insulating surface layer 9 laminated on electroconductive layer 8. Substrate 10 can be in the form of a transparent drum or a belt and rotates in the direction of an arrow 65. Transparent insulating layer 9 preferably includes an organic or inorganic material having low surface energy.

When image forming substrate 10 rotates in the direction of arrow 65 and magnetic brush 6 places toner 1 in contact with insulating surface layer 9, a writing head 11 applies an exposure 12 from inside image forming substrate 10. The exposure is applied towards magnetic brush 6 where magnetic brush 6 is in contact with substrate 10 and reduces the resistivity of toner 1 in contact with image forming substrate 10. Because substrate 10 is effectively transparent to exposure 12, photoconductive toner will be selectively exposed and the resistance of exposed toner 1 will be reduced.

A bias voltage is applied between transparent conductive layer 8 and conductive sleeve 5 by a voltage source 13. Positive charges from voltage source 13 flow into exposed toner 1 due to the reduction in the resistance of exposed toner 1 and reverse the charge of toner 1. Because voltage source 13 applies a negative charge to conductive layer 8, positively charged exposed toner particles adhere to the surface of substrate 10 due to electrostatic forces.

Voltage source 13 should supply a bias voltage of less than about 500 volts DC. If the bias voltage exceeds about 500 volts, even unexposed toner having high resistivity can be unintentionally positively charged. It will then adhere to the surface of image forming substrate 10 and lead to undesirable background fogs in the ultimate image.

As substrate 10 continues to rotate in the direction of arrow 65, toner 1 adhering to the surface of substrate 10 contacts a transfer medium, such as a transfer paper 14 moving in the direction of an arrow 66. A transfer device, such as a transfer charger 15 applies a negative charge from behind transfer paper 14 to lift positively charged toner 1 from substrate 10 onto paper 14 by electric force.

The transfer of toner 1 to transfer paper 14 can be accomplished by other methods. The method used is not limited to electrostatic transfer. For example, other transfer methods can include electric field transfer, adhesion transfer, heat pressure transfer and other suitable methods for transferring toner from a substrate to a recording medium.

After toner 1 is transferred to transfer paper 14, it is fixed by using a heat fixing roller 16. Alternatively, pressure and heat-pressure fixing methods can be used. If desired, a cleaning blade 17 and a charge elimination device 18 are arranged around substrate 10 to remove untransferred toner and to restore proper charge to substrate 10.

Figure 3:
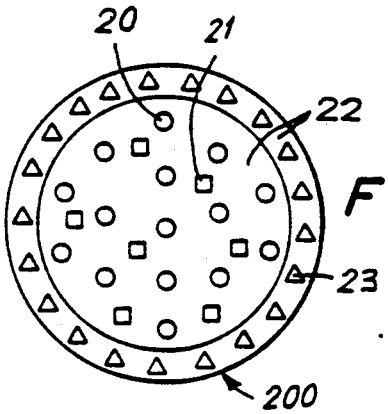
FIG. 3 is a sectional view of an improved photoconductive toner particle in accordance with the invention.
Figure 4:
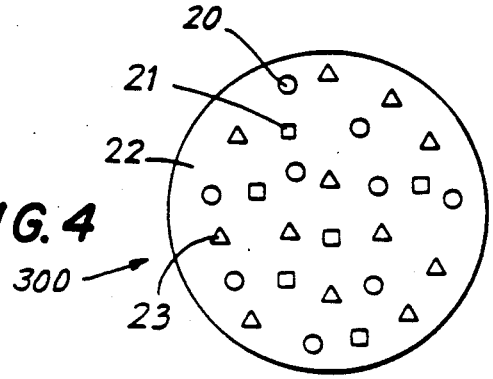
FIG. 4 is a sectional view of another improved photoconductive toner particle in accordance with the invention.

Proper operation of image forming apparatus 100 depends on selection of a photoconductive toner in which resistance to electrical flow is reduced during exposure. FIGS. 3 and 4 are sectional views of different type particles of photoconductive toner which can be used with apparatus 100. Toner 200 and toner 300 include a colorant 20 and additives 21 dispersed in a binder resin 22. Toner 200 further includes a coating of binder resin 22 which includes a photoconductive agent 23. Photoconductive agent 23 can be uniformly dispersed, as in toner 300.

Various materials can be used as components of toners 200 and 300. Additives 21 can include fluidity improving agents and charge control agents. Appropriate photoconductive agents 23 include zinc oxide, titanium oxide, phthalocyanine, quinacridone, benzidine and the like. In addition, depending on conditions, a sensitizing dye can be adsorbed to photoconducting agent 23 to sensitize photoconducting agent 23 to a wave length corresponding to exposure 12 from writing head 11. Binder resins 22 include thermoplastic resins, such as acryl, polyester, styrene, styrene-acrylonitrile copolymer, epoxy, silicone, butyral and vinyl acetate, as well as wax resins.

Several methods can be used to form photoconductive toner 200 and 300 from the above described starting materials. For example, the starting materials can be dispersed in a solvent and then sprayed and dried to form spherical toner particles having an average grain size of about 9 to 11 μm. Preferably, materials should be selected to form a photoconductive toner having an unexposed resistivity of more than about $10^{15}$ Ω·cm and an exposed resistivity of less than about $10^{8}$ Ω·cm.

Apparatus 100 can be modified, if desired, without adversely affecting printing quality. For example image forming substrate 10 can be in the form of a transparent drum or transparent belt. Transparent insulating layer 9 of substrate 10 can include inorganic or organic material with low surface energy. Writing head 11 can include apparatuses such as a semiconducting laser, light emitting diodes (LED), liquid crystal shutter (LCS) and other common exposure writing implements. Further, the toner can be a mixture of different colored toners sensitized to different exposures so that multi-color images can be formed.

Images were formed with toners 200 and 300 and apparatus 100. The images were clear and had an optical density (O.D.) of more than about 1.5 with satisfactory reproducibility and inconsequential background fogs.

The following examples are set forth to describe image forming and toners in accordance with the invention more clearly. They are intended as illustrative only and not presented in a limiting sense. All percentages set forth are by weight, unless otherwise indicated.

EXAMPLE 1

Figure 5:
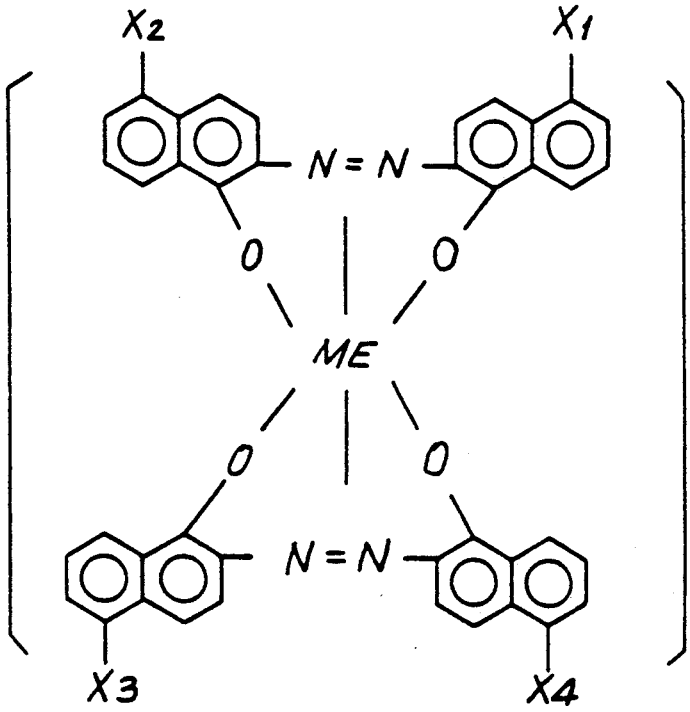
FIG. 5 shows the chemical structure of an improved black dye for use with photoconductive toners in accordance with the invention.

Images were printed using image forming apparatus 100 of FIG. 1. The toner included a black dyestuff-1 having the chemical structure, shown in FIG. 5, wherein Me is Cr; $X_1$ and $X_3$ represent a methyl group; and $X_4$ represents sodium sulfonate. The photoconductive toner included about 80 parts butyral resin and 20 parts by weight black dyestuff-1.

The toner was prepared by dissolving butyral resin and black dyestuff-1 in ethanol and mixing the solutions. This combination was stirred until the composition became uniform and toner grains of about 10 μm in size were prepared by a spray-drying method.

Because these toners contained a black photoconductive agent, the toner could absorb electromagnetic radiation from the entire visible range. Therefore, a wide range of light sources such as LCS, LED, visible semiconductor lasers etc. can be used to expose a toner of this type. In addition, if image forming apparatus 100 is used as a copying machine, the typically included fluorescent lamps are also acceptable for exposure.

Images were formed with this toner of Example 1 with a liquid crystal shutter as the light source. Clear images were formed having an optical density of about more than 1.5 and satisfactory reproducibility with no background fogs were obtained.

EXAMPLE 2

Several different photoconductive toners, similar to the toner from Example 1 were prepared and images were formed using image forming apparatus 100. Toners of this Example 2 differ from those of Example 1 in that the ratio of black dyestuff-1 to resin was varied to examine the influence of dyestuff percentage on printing quality. The results of images formed by using the toners with different ratios of black dyestuff-1 are shown in Table 1 below.

As shown in Table 1, images were not formed when the percentage of black dyestuff-1 was less than about 10% or more than about 70%. If the percentage of black dyestuff is below about 10%, images were not formed because the sensitivity of the toner to the exposure was insufficient. Furthermore, if the percentage of black dyestuff exceeded about 70%, the toners did not become properly charged, considerable background fog was produced and acceptable images were not formed. Accordingly, the best clear black images were formed with a percentage of black dyestuff-1 ranging from about 15 to 70% and more preferably from about 20 to 50%.

TABLE 1

| Exp. No. | Resin (%) | Black dyestuff-1 (%) | Image Formation Results |
|---|---|---|---|
| 1 | 95 | 5 | no image |
| 2 | 90 | 10 | poor resolution |
| 3 | 85 | 15 | good |
| 4 | 80 | 20 | clear |
| 5 | 50 | 50 | clear |
| 6 | 40 | 60 | clear |
| 7 | 30 | 70 | considerable background fog |

EXAMPLE 3

Figure 6:
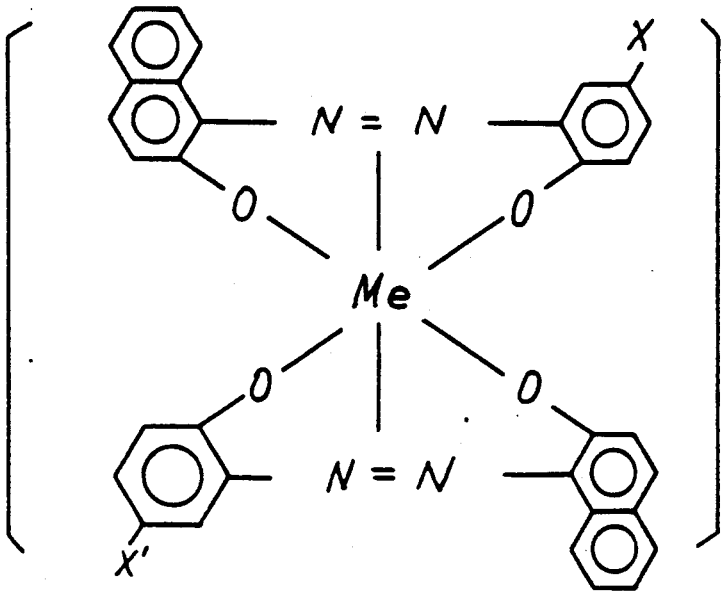
FIG. 6 shows the chemical structure of another improved black dye for use with photoconductive toners in accordance with the invention.

Images were formed as in Example 1, but with toner which included black dyestuff-2, shown in FIG. 6, rather than black dyestuff-1. Dyestuff-2 is similar to black dyestuff-1, except that benzene rings are attached to the side chain in place of the naphthalene rings which are present in black dyestuff-1 shown in FIG. 5. Black dyestuff-2 was combined with styrene acrylic resin and photoconductive toners were prepared as in Example 1 by the spray drying method. The images formed were as clear as in Example 1.

Further, several photoconductive toners were prepared by varying the proportion of black dyestuff-2 to the proportion of binder resin. The results of printing with the different toners were similar to the results from Example 2. The most preferred percentage of black dyestuff-2 ranged from about 20 to 50%.

EXAMPLE 4

Several different photoconductive toners were prepared as in Examples 1–3, but with different metals and different side chain functional groups substituted on the previously described dyestuff compounds. The different coordinated metals and functional groups evaluated are listed in Table 2 below. Resulting images were clear, had an optical density of about 1.5 or better, had satisfactory reproducibility and no background fog.

TABLE 2

| | |
|---|---|
| Coordinated metal: | Na, Mg, Al, Si, K, Ca, Ti, Cr, Mn, Fe, Co, Ni, Cu, Zn, Ga, Ge, In, Sn, Ba, Ta, Mo, Li, Zr, Y, V, Sc, Pb |
| Functional group: | $C_nH_{2n+1}$, COOH, COOR, OH, OR, $NH_2$, $NHNO_2$, NO, SH, $SO_3H$, $SO_3R$, $SO_2H$, $SO_2R$, SOH, SOR, CHO, Halogen, H |

(R: alkali metal or hydrocarbon group)
(n: integer of 1 to 7)

EXAMPLE 5

A photoconductive toner including black dyestuff-1 formed as in Example 2 as the colorant and the sensitizer and including zinc oxide as the photoconductive agent was prepared and evaluated. The proportions of ingredient were as follows: zinc oxide—40 parts by weight; acryl resin—40 parts by weight; and black dyestuff-1—20 parts by weight.

Photoconductive toners having about a 10 μm particle size were prepared by grinding. To produce particles of this size, a series of kneading and pulverizing steps were used to grind the toner material to the appropriate size. Specifically, the st include mixing, kneading, coarse pulverization, fine pulverization and size classification. Because the toner is sensitized by black dyestuff-1, it absorbs light over the visible region. Therefore, light sources such as liquid crystal shutter, light emitting diode, visible semiconductor lasers, etc. can be used to expose this toner. Furthermore, if a copying machine application is desired, a fluorescent lamp can be employed.

Images were formed as in Example 1, using a liquid crystal shutter as the light source. Clear images having an optical density of more than about 1.5 were obtained with satisfactory reproducibility and no background fogs.

EXAMPLE 6

Toner, including black dyestuff-2, shown in FIG. 6 was prepared and evaluated as follows. The toner included about 45 parts by weight zinc oxide; 45 parts by weight butyral resin; and 10 parts by weight black dyestuff-2. Photoconductive toner particles were prepared by the spray drying method.

To form the toner particles, a predetermined amount of black dyestuff-2 was dissolved into ethanol. Zinc oxide was added and dispersed with supersonic waves. It absorbed black dyestuff-2. The solution was mixed with butyral resin, dissolved in ethanol and subjected to further supersonic dispersion to obtain a uniform dispersion. 10 μm size toner particles were then prepared by spray drying. Images were formed as in Example 5 with this toner and the images were likewise acceptable.

EXAMPLE 7

The effects of varying the percentage of black dyestuff-1 as the colorant and sensitizer of the toner described in Example 5 were analyzed. As shown in Table 3 below, when the percentage of black dyestuff-1 is less than about 3% or more than about 40% the quality of the images formed from these toners deteriorates. As shown in Table 3, when the percentage of black dyestuff-1 was within the preferred range, at least 15 out of 20 individuals analyzing the formed images concluded that clear images were formed.

TABLE 3

| Exp. No. | Resin (%) | Zinc oxide (%) | Black Dyestuff-1 (%) | Image Formation Results |
|---|---|---|---|---|
| 1 | 50 | 47 | 3 | O.D. less than 1.5 |
| 2 | 50 | 45 | 5 | clear |
| 3 | 45 | 45 | 10 | clear |
| 4 | 45 | 25 | 30 | clear |
| 5 | 40 | 20 | 40 | background fog |
| 6 | 40 | 10 | 50 | no images formed |

As shown in Table 3, the range of black dyestuff-1 should be between about 3 and 30%. Preferably, the percentage of black dyestuff-1 should be from about 5 to 30%. If the ratio of black dyestuff-1 is less than about 3%, insufficient optical density is obtained However, if the percentage of black dyestuff-1 exceeds about 30%, the electrical resistance is reduced which adversely affects the charging properties of the toner. Therefore, it becomes more difficult to properly transfer toner to the image forming substrate. Most preferably, the range should be from about 10 to 20%.

A similar experiment was conducted with black dyestuff-2 used in Example 6. Black dyestuff-2 exhibited the same results and tendencies as black dyestuff-1. Accordingly, the same ranges of black dyestuff-2 should be included when preparing toner with this dyestuff.

EXAMPLE 8

The previously described photoconductive toners were further evaluated. Toners were prepared as in Examples 5–7 with the black dyestuffs shown in Table 2 as in Example 4. The black dyestuff used with the photoconductive toners were the dyestuffs shown in Examples 5–7. The images formed were similar to those described in Examples 5–7.

EXAMPLE 9

Figure 7:
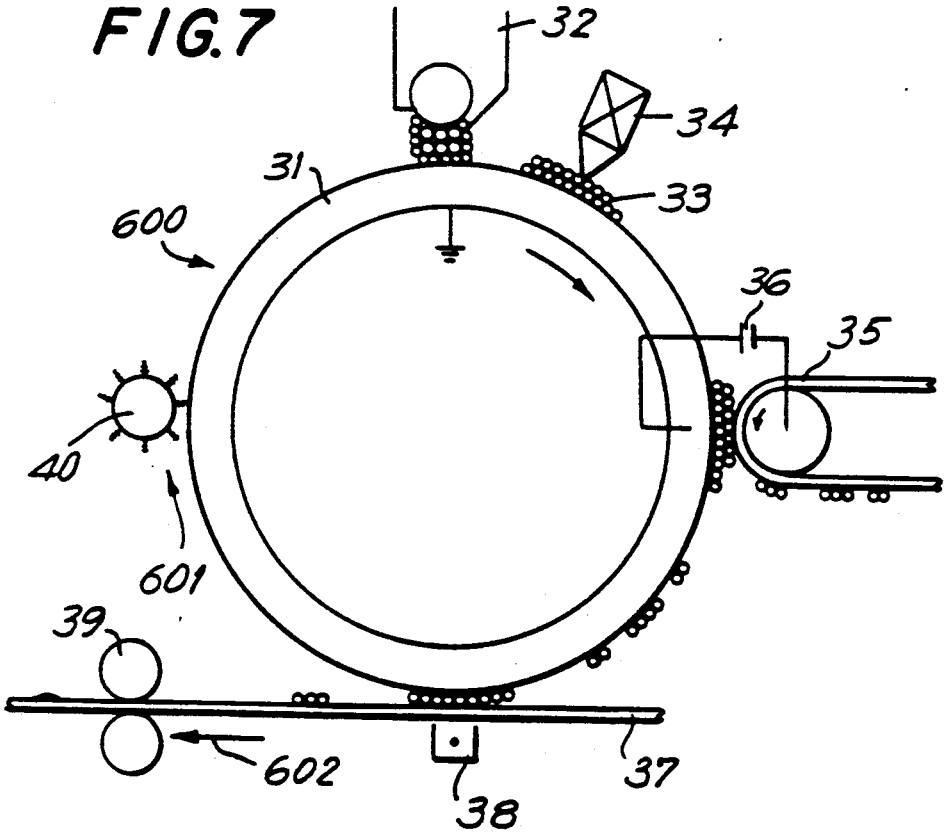
FIG. 7 is a sectional view of another improved image forming apparatus in accordance with the invention.

Images were formed with the photoconductive toners described in Examples 5–8 to form images with an apparatus 600 shown in FIG. 7. Apparatus 600 employs a different image forming method in which, rather than toner being applied to a substrate in the form of an image, a uniform layer of photoconductive toner 33 is applied to a conductive substrate 31 by a two component magnetic brush 32. Exposed toner 33 is removed and the remaining toner corresponds to the latent image.

To form images with apparatus 600, the following steps take place as conductive substrate 31 rotates in the direction of arrow 601. A uniform thin layer of photoconductive toner 33 is applied to electroconductive substrate 31 by two-component magnetic brush 32. For this example, the toner is negatively charged in magnetic brush 32, but the process works the same way with charges reversed. Charging polarity depends on the charging properties of the thermoplastic resins and other toner components.

An exposure system 34 exposes toner layer 33 with a latent image. It is the unexposed toner that will eventually be transferred to a suitable transfer medium such as transfer paper 37. A DC voltage source 36 supplies a bias voltage between conductive substrate 31 and an intermediate toner removal device 35. Current flows from voltage source 36 to exposed toner 33. The voltage should be kept below about 750V to avoid reversing the charge of unexposed toner. This exposed toner 33, positively charged by voltage source 36, adheres to negatively charged intermediate toner removal device 35. The remaining toner, corresponding to the desired latent image remains adhered to conductive substrate 31. Toner 33 is then transferred to transfer paper 37 by any electrostatic transfer method such as using a corona transfer device 38.

Negatively charged unexposed toner 33 will not adhere to intermediate toner removal device 35. As substrate 31 continues to rotate in the direction of arrow 601, unexposed toner 33 comes into contact with a transfer medium such as transfer paper 37 moving in the direction of arrow 602. Toner 33 is then lifted onto paper 37 by an electrostatic transfer device such as corona transfer device 38. A fixing device such as heat roller 39 fixes toner 33 to transfer paper 37. A cleaning brush 40 then removes excess toner from the surface of conductive substrate 31 and the process can be repeated.

As noted in previous examples, image writer 34 can be any of a liquid crystal shutter, light emitting diode, visible semiconductor laser and the like. A fluorescent lamp can be used for photocopying applications. Because the toners selected for this example were sensitive over the entire visible region, any of the above writing devices could have been used. For this example, exposure was from a liquid crystal shutter.

High quality images were formed with apparatus 600. A printing speed of 20 pages per minute and a resolution of 300 dots per inch were obtained. Satisfactory images having good reproducibility even after 10,000 printing cycles were obtained. The images had an optical density of above about 1.5. The light from exposure system 34 had an energy of 10 erg/cm$^2$ and the voltage source 36 applied a voltage of less than about 750V.

EXAMPLE 10

Photoconductive toners were similar to toner 300 of FIG. 4 formed with black dyestuff-1 as the colorant and zinc oxide sensitized With cyanine dye as the photoconductive agent. Images were formed using these toners and the image forming method of apparatus 100.

Figure 8:
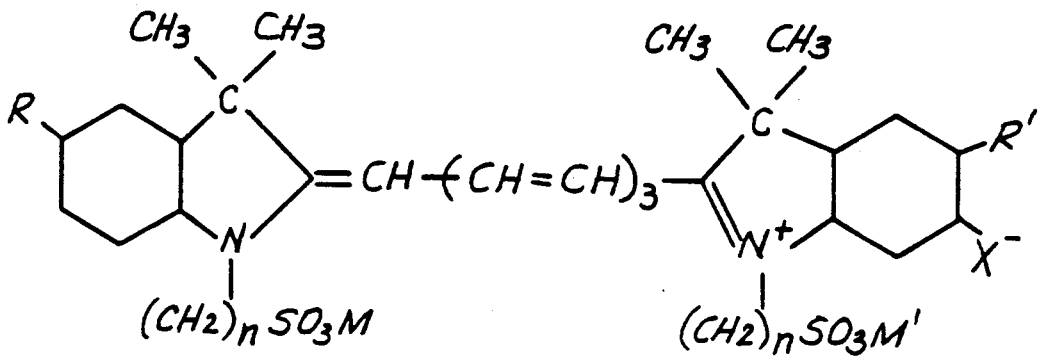
FIG. 8 shows the chemical structure for a light sensitizing agent to be included within toner in accordance with the invention.
Figure 9:
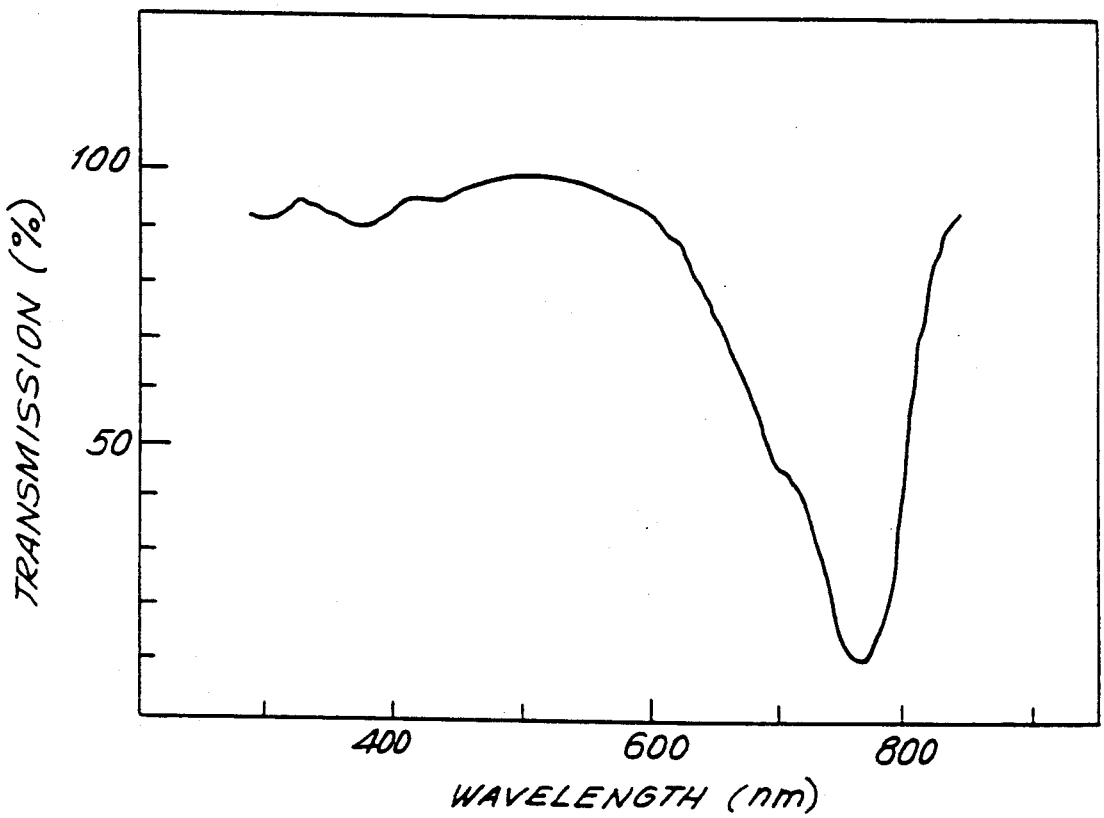
FIG. 9 is a graph showing the spectral transmission of a cyanine dye.

The general chemical structure of the cyanine sensitizing dye is shown in FIG. 8. For this example, a cyanine dye was used in which n=4, M=H, M'=Na, X=I and R=a benzene ring. The spectral transmission curve of the cyanine dye of this example is shown in FIG. 9. It has an absorption peak at 780 nm. 40 parts by weight zinc oxide, 0.04 parts by weight cyanine dye, and 80 parts by weight ethanol were uniformly mixed, dispersed by supersonic waves and the cyanine dye was absorbed into the zinc oxide. The ethanol was then removed to yield a powder of zinc oxide having cyanine dye absorbed therein.

Figure 10:
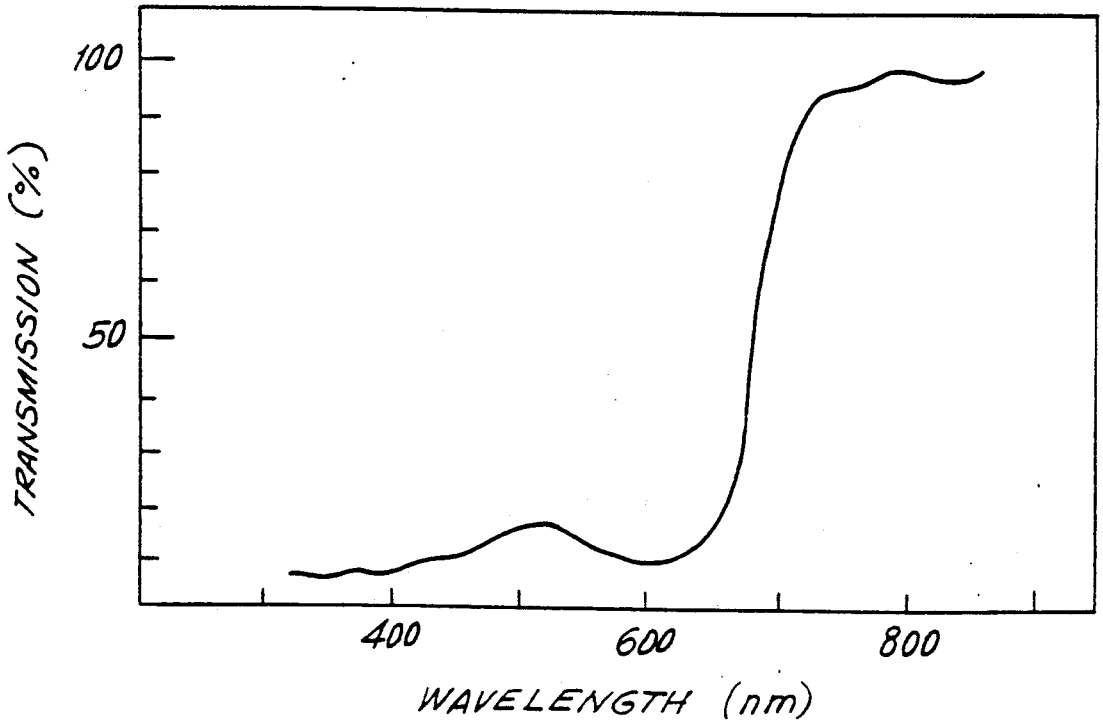
FIG. 10 is a graph showing the spectral transmission of a black dye.

Toner containing black dyestuff-1 and cyanine sensitized ZnO was then formed. 40 parts by weight Butyral resin and 20 parts by weight Black dyestuff-1 was mixed with ethanol. For this example, black dyestuff-1 had the structure shown in FIG. 5 in which Me is Cr, $X_1$ and $X_3$ are long-chained methyl group and $X_2$ and $X_4$ are long-chain ethyl groups. The spectral curve for black dyestuff-1 is shown in FIG. 10. It has no absorption in the near infrared region.

The cyanine dye-absorbed zinc oxide powder was mixed in the ethanol solution containing the butyral resin and black dye stuff. Supersonic waves were used to uniformly disperse mixture. Photoconductive toners have a particle size of about 10 μm were prepared by spray-drying.

This toner was used to form images. The exposure device for this example was a near infrared semiconductor laser. Light from this exposure device was not absorbed by black dyestuff-1 which has no absorption peak in the near infrared region but the emission from the laser was absorbed by the cyanine dye on the surface of zinc oxide. Clear images with an optical density of about 1.5 were obtained with satisfactory reproducibility and no background fogs.

EXAMPLE 11

The effects of varying the amount of cyanine dye added to zinc oxide was evaluated as follows. Images were formed as in Example 10 with apparatus 100 of FIG. 1. The fundamental composition of the toners was the same as in Example 10, except that the resin was acrylic resin and the black dyestuff was black dyestuff-2 in which Me is Cr, $X_1$ and $X_3$ are long-chain methyl groups and $X_2$ and $X_4$ are long-chain ethyl groups. The different toners prepared are shown below in Table 4 and the results of forming images with the different toners is also shown in Table 4. When less than about 0.1 mg of cyanine dye was added in per gram of zinc oxide or more than about 10 mg cyanine dye per gram zinc oxide was added, the resulting images deteriorated.

TABLE 4

| Exp. No | mg Cyanine dye per gram ZnO | Image Formation Results |
|---|---|---|
| 1 | 0.001 | no image formed |
| 2 | 0.01 | O.D. less than 1.5 |
| 3 | 0.1 | clear |
| 4 | 1 | clear |
| 5 | 5 | clear |
| 6 | 10 | no image formed |

As shown in Table 4, if less than about 0.01 mg or more than about 5 mg of cyanine dye is added per gram of zinc oxide, the images formed were unsatisfactory. However, when between about 0.1 to 5 mg of cyanine dye were added per gram zinc oxide, at least 15 out of 20 observers concluded that the resulting images were clear. Accordingly, between about 0.01 and 5 mg of cyanine dye should be included per gram of ZnO.

EXAMPLE 12

The effects of varying the percentage of black dyestuff-1 in toners containing one mg cyanine dye per gram ZnO were evaluated. Images were formed as in Example 11, except that the binder resin in the toner was acrylic resin the adsorption amount of cyanine dye was 0.1% and the percentage of black dyestuff-1 was varied. The results of varying the percentage of black dyestuff-1 on the images formed are shown below in Table 5. When the percentage of black dyestuff-1 was less than about 3% the optical density fell below about 1.5. When the percentage of black dyestuff-1 increased above about 40%, the frequency of blank portions increased.

TABLE 5

| Exp. No. | Dye percentage | Image Formation Results |
|---|---|---|
| 1 | 3 | O.D. less than 1.5 |
| 2 | 5 | clear |
| 3 | 10 | clear |

TABLE 5-continued

| Exp. No. | Dye percentage | Image Formation Results |
|---|---|---|
| 4 | 30 | clear |
| 5 | 40 | blank portions formed |
| 6 | 50 | no image formed |

As shown in Table 5, when the ratio of black dyestuff-1 is between about 5 and 30%, the optical density is more than about 1.5 and at least 15 out of 20 observers considered the formed images to be clear. The most preferable range of black dyestuff-1 is from about 10 to 20%. Similar results were also obtained when black dyestuff-2 from Example 11 was substituted for black dyestuff-1.

EXAMPLE 13

Photoconductive toners were prepared by the kneading and pulverization method. The toner had a composition by weight of: 30 parts zinc oxide, 0.03 parts cyanine dye, 60 parts polybutyl methacrylate resin, 4 parts charge control and parts black dyestuff-1. After the steps of kneading, coarse pulverization, fine pulverization and classification, toners having particle size of about 10 μm were prepared.

By including charge control agent, the charging property of the toner can be controlled regardless of the charging property of the resin. Images were formed as in Example 10. Clear images having an optical density of about 1.5 were obtained with good reproducibility.

EXAMPLE 14

Photoconductive toners were prepared as in Examples 10–13, but with a cyanine dye having a structure in which n=3, M=H, M'=$SO_3$ and no R. Images were formed as in Examples 10–13 with the same acceptable printing quality.

EXAMPLE 15

Photoconductive toners were prepared as in Examples 10–14, with the same dyestuffs as in Table 2. Images were formed as in Examples 10–14 and the same image forming results were obtained.

EXAMPLE 16

Images were formed as in Example 9 using photoconductive toners prepared for Examples 10–15.

Zinc oxide was sensitized to the near infrared region by a sensitizing dye. An inexpensive semiconductor near infrared emitting laser was used as the exposing device. The laser emitted light having 10 erg/cm$^2$. The bias voltage was less than about 750 V during intermediate toner removal. A printing speed of about 20 pages per minute was obtained with a resolution of about 300 dots per inch as in Example 8. The images had an optical density of more than about 1.5. Furthermore, satisfactory images could even be obtained with good reproducibility after 10,000 printing cycles.

EXAMPLE 17

Color images were formed using apparatus 100 as in Example 1. Toner hopper 2 contained a uniform mixture of 3 colored photoconductive toners. Images were formed as described in Example 1 except that exposure corresponding to 3 different color image signals was conducted concurrently. For this example, a liquid crystal shutter was used as writing head 11 but a laser or LED system could also have been used.

The three color photoconductive toners were prepared as follows with the following compositions by weight:

1) Cyan photoconductive toner 1. 100 parts Acryl-styrene copolymer and 50 parts Phthalocyanine were dissolved in acetone. Thereafter, spherical colored particles of about 10 μm in size were prepared by the spray-drying method.

2. The light sensitizer was adsorbed into zinc oxide by dispersing 10 parts zinc oxide, 0.01 parts phthalic acid anhydride and 0.01 parts Methylene blue in 20 parts Ethanol and subjecting the mixture to supersonic waves for one hour. The ethanol was removed and the methalyne blue sensitizer was thereby adsorbed on the surface of the zinc oxide.

3. The colored particles were then coated with the photoconductive agent. The sensitized zinc oxide was added to and uniformly dispersed in 10 parts Polybutyl Methacrylate and 200 parts Acetone. The colored particles containing acryl-styrene copolymer were added thereto and dispersed with supersonic waves. This solution was sprayed into pellets by the spray-drying method to yield colored photoconductive toner having particle size of about 11 μm. The photoconductive layer of these particles is coated on the surface of the color particles similar to toner 200 shown in FIG. 3.

Magenta photoconductive toner and yellow photoconductive toner were prepared in the same manner as the cyan photoconductive toner. The compositions of these toners are shown in Table 6.

TABLE 6

| | | | |
|---|---|---|---|
| Magenta toner | 1 | Acryl-stylene copolymer | 100 parts by weight |
| | | Rhodamine B lake | 50 parts by weight |
| | 2 | Zinc oxide (ZnO) | 10 parts by weight |
| | | Phthalic acid anhydride | 0.01 parts by weight |
| | | Eosine Y | 0.01 parts by weight |
| | | Ethanol | 20 parts by weight |
| | 3 | Polybutyl methacrylate | 10 parts by weight |
| | | Acetone | 200 parts by weight |
| Yellow toner | 1 | Acryl-styrene copolymer | 100 parts by weight |
| | | Benzidine derivative | 50 parts by weight |
| | 2 | Zinc oxide (ZnO) | 10 parts by weight |
| | | Phthalic anhydride | 0.01 parts by weight |
| | | Solar Pure Yellow 8G | 0.01 parts by weight |
| | | Ethanol | 20 parts by weight |
| | 3 | Polybutyl methacrylate | 10 parts by weight |
| | | Acetone | 200 parts by weight |

Colored images were formed with the three color photoconductive toners prepared as described above. Clear color images having excellent color reproducibility were obtained.

EXAMPLE 18

Photoconductive toners having the same starting materials as in Example 17 were prepared by the kneading and pulverization method. Results similar to the results of Example 17 were obtained. In addition to the colorants of Example 17, other dyestuffs such as carmine 6B, quinacridone, polywolframate phosphoric acid, indanthrene blue and sulfone amide derivative can also be used.

As described above, clear images having high contrast and no background fogs can be formed with good reproducibility according to the invention. A method according to the invention includes forming a magnetic brush from photoconductive toner and magnetic conductive carrier; bringing the magnetic brush into contact with a transparent image forming substrate having an insulating surface; exposing the magnetic brush from within and through the substrate while applying a bias voltage to the substrate and the toner (the exposure will reduce the resistivity of the toner). Accordingly, the resistance of the exposed toner is reduced so that it can become charged and therefore adhere to the image forming substrate. Clear images of remarkable quality can be thereby formed with an apparatus which is small in size, low in cost and does not include photoreceptors.

Photoconductive toners according to the invention can contain azo type metal-containing black dyestuffs which overcome known problems of photoconductivity and provide clear black photoconductive toner. Furthermore, these toners can be simply prepared and therefore cheaply produced. Because the black dyestuff has no absorption peak in the near infrared region, it can be combined with a cyanine sensitizing dye to enable the use of an inexpensive near infrared semiconductor laser as a light source/writing device.

In addition, according to the invention, different colored toners each sensitized to a different frequency can be mixed, and multicolored images can be formed with one developing step. Accordingly, when the toner, method and apparatus of the invention are combined, high quality high output image formation can be affected as low cost simple machines.

It will thus be seen that the objects as set forth, among those made apparent from the proceeding description, are efficiently attained and, since certain changes may be made in carrying out the above method and the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Particularly, it is to be understood that in said claims, ingredients or compounds were cited in the singular are intended to include compatible mixtures of such ingredients wherever the sense remits.

What is claimed is:

1. A photoconductive image formation apparatus comprising:

a transparent insulating image forming substrate including a transparent conductive layer and a transparent insulating surface disposed thereon;

developer means including photoconductive toner particles and electroconductive carrier particles on an electroconductive transport support for triboelectrically charging the toner particles on the electroconductive transport support, the developer means positioned adjacent to the image forming substrate so that the charged toner particles on the electroconductive transport support contact the image forming substrate, the toner particles having lowered resistivity when exposed with an appropriate wavelength;

exposure means for exposing the toner on the electroconductive transport support contacting the substrate, through the substrate, with an exposure of an appropriate wavelength, corresponding to an image;

bias voltage means for maintaining a DC bias voltage between the electroconductive transport support and the image forming substrate, the voltage too low to reverse the charge of unexposed toner, but high enough to reverse the charge of exposed toner, so that exposed toner from the electroconductive transport support will adhere to the image forming substrate in the form of an image; and transfer means for transferring toner from the image forming substrate to a transfer medium.

2. The photoconductive image forming apparatus of claim 1, wherein the photoconductive toners include an a azo-type metal black dye.

3. The photoconductive image forming apparatus of claim 1, wherein the photoconductive toners include a cyanine-type dye.

4. The photoconductive image formation apparatus of claim 1, wherein the photoconductive toner includes a mixture of differently colored toners, each color toner sensitized to a different exposure wavelength so that a single multiple wavelength exposure will reduce the resistivity of as many as each differently colored toner to form multicolor images.

5. The photoconductive image formation apparatus of claim 4, wherein the toner includes a colorant and a photoconductive agent dispersed in a binder resin.

6. The photoconductive image formation apparatus of claim 5, wherein the photoconductive agent is dispersed within a layer of binder resin and coats a particle, the particle including binder resin and colorant.

7. The photoconductive image formation apparatus of claim 4, wherein the toner includes azo-type metal dyes.

8. The photoconductive image formation apparatus of claim 7, wherein the toner contains an azo-type metal black dye having no exposure absorption in the photosensitive wavelength region of the toner.

9. The photoconductive image formation apparatus of claim 1, wherein the toner includes a binder resin, photoconductive agent and a colorant, the toner including a dyestuff having the formula:

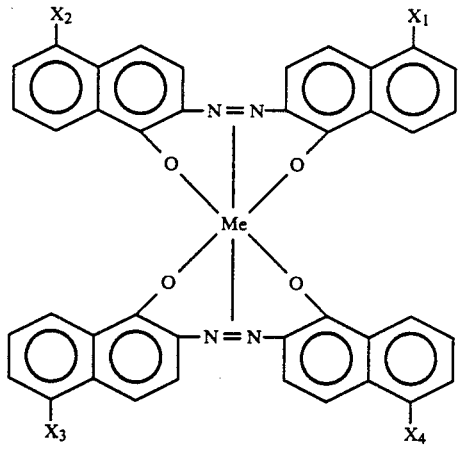

in which X is selected from the group consisting of —COOR, $SO_3R$, an alkyl group and a hydroxyl group and R is one of an alkali metal and hydrocarbon radical and Me is a metal.

10. The apparatus of claim 9, wherein Me is a metal selected from the group consisting of Na, Mg, Al, Si, K, Ca, Ti, Cr, Mn, Fe, Co, Ni, Cu, Zn, Ga, Ge, In, Sn, Ba, Ta, Mo, Li, Zr, Y, V, Sc, Pb and $X_1$, $X_2$, $X_3$ and $X_4$ are functional groups selected from the group consisting of $C_nH_{2n+1}$, COOH, COOR, OH, OR, $NH_2$, $NHNO_2$, No, SH, $SO_3H$, $SO_3H$, $SO_2R$, SOH, SOR, CHO, Halogen, H and R is one of an alkali metal and a hydrocarbon group and n is an integer from 1 to 7.

11. The apparatus of claim 9, wherein Me is Cr, $X_1$ and $X_3$ are methyl groups and $X_4$ is sodium sulphonate and the binder resin is butyral resin.

12. The apparatus of claim 9, wherein the toner contains between about 15 to 70% dyestuff, by weight.

13. The apparatus of claim 9, wherein the toner contains between about 20 to 50% dyestuff, by weight.

14. The photoconductive image formation apparatus of claim 1, wherein the toner includes a binder resin a photoconductive agent and a colorant, the toner including a dyestuff having the formula:

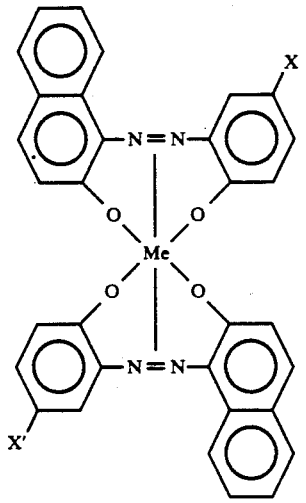

in which X and X' are functional groups selected from the group consisting of hydrogen, COOR, SOR, alkyl groups and hydroxyl groups and R is one of an alkali metal or hydrocarbon radical.

15. The apparatus of claim 14, wherein the toner includes between about 15 to 70% dyestuff, by weight.

16. The apparatus of claim 14, wherein the toner includes between about 20 to 50% black dyestuff, by weight.

17. The apparatus of claim 9, wherein the photoconductive agent includes zinc oxide and cyanine dye.

18. The apparatus of claim 14, wherein the photoconductive agent includes zinc oxide and cyanine dye.

19. The apparatus of claim 17, wherein the toner contains between about 0.1 to 5 mg of cyanine dye per gram of zinc oxide.

20. The apparatus of claim 18, wherein the toner contains between about 0.1 to 5 mg of cyanine dye per gram of zinc oxide.

* * * * *

UNITED STATES PATENT AND TRADEMARK OFFICE

CERTIFICATE OF CORRECTION

PATENT NO. : 5,053,821
DATED : October 1, 1991
INVENTOR(S) : Masanoe Kunugi, et al.

It is certified that error appears in the above-identified patent and that said Letters Patent is hereby corrected as shown below:

column 4, line 35, after "invention", add --, in which X is -COOR, $SO_3R$, alkyl group or hydroxyl group (R: alkali metal or hydrocarbon radical)--;

line 38, after "invention", add --, in which X and X' are selected from independent hydrogen or from -COOR, SOR, alkyl group and hydroxyl group (R: alkali metal or hydrocarbon radical)--; and line 43, after "invention", add --, in which n is an integer of 1 to 7, X is a negative ion of acid, M and M' are independent hydrogen and alkali metal and R and R'are independent hydrocarbon group and benzene ring--.

Signed and Sealed this

Twenty-sixth Day of January, 1993

*Attest:*

STEPHEN G. KUNIN

*Attesting Officer*

*Acting Commissioner of Patents and Trademarks*